US012527367B2

(12) United States Patent
Glenn

(10) Patent No.: US 12,527,367 B2
(45) Date of Patent: Jan. 20, 2026

(54) SCREEN JUMPSUIT

(71) Applicant: April Ann Glenn, Euless, TX (US)

(72) Inventor: April Ann Glenn, Euless, TX (US)

( * ) Notice: Subject to any disclaimer, the term of this patent is extended or adjusted under 35 U.S.C. 154(b) by 0 days.

(21) Appl. No.: 18/369,294

(22) Filed: Sep. 18, 2023

(65) Prior Publication Data

US 2024/0074520 A1 Mar. 7, 2024

Related U.S. Application Data

(60) Provisional application No. 63/403,064, filed on Sep. 1, 2022.

(51) Int. Cl.
*A41D 13/00* (2006.01)
*A41D 31/24* (2019.01)

(52) U.S. Cl.
CPC ..... *A41D 13/001* (2013.01); *A41D 31/24* (2019.02)

(58) Field of Classification Search
CPC ..... A41D 13/001; A41D 31/24
See application file for complete search history.

(56) References Cited

U.S. PATENT DOCUMENTS 4,422,184 A * 12/1983 Myers ..... A01K 55/00 2/84
4,685,152 A * 8/1987 Heare ..... A41D 13/001 2/84
4,716,594 A * 1/1988 Shannon ..... A41D 31/04 2/DIG. 1
5,091,993 A * 3/1992 Merrill ..... A42B 1/046 2/202
5,119,510 A * 6/1992 Schilling ..... A42B 1/045 2/202
5,357,635 A * 10/1994 Lemoine ..... A41D 13/001 2/84
5,600,850 A * 2/1997 Shannon ..... A41D 13/001 2/69
5,717,990 A * 2/1998 Alquist ..... A01K 55/00 2/202
2006/0048291 A1* 3/2006 Sims ..... A41D 13/02 2/456
2013/0232676 A1* 9/2013 Corzatt ..... A41D 13/0002 2/455
2014/0352043 A1* 12/2014 Harvey ..... A41D 13/001 2/114

* cited by examiner

*Primary Examiner* — Gloria M Hale
(74) *Attorney, Agent, or Firm* — Kirby Drake

(57) ABSTRACT

A jump screen may be a jump suit formed of one or more fabrics (and combinations of the same) that may limit access of insects to contact with a wearer's skin. The fabrics may be those that may be used for the mesh of window screens. The jump suit may include drawstrings or other closure mechanisms around the ankle portions and/or wrist portions of the jump suit so that insects may not enter through the ankle or wrist openings of the jump suit to contact with the wearer's skin. The jump suit may include a hood portion having a drawstring that may seal or close around the wearer's face area. The jump suit may include hook and loop fasteners for the wearer to put on the jump suit and close it.

7 Claims, 1 Drawing Sheet

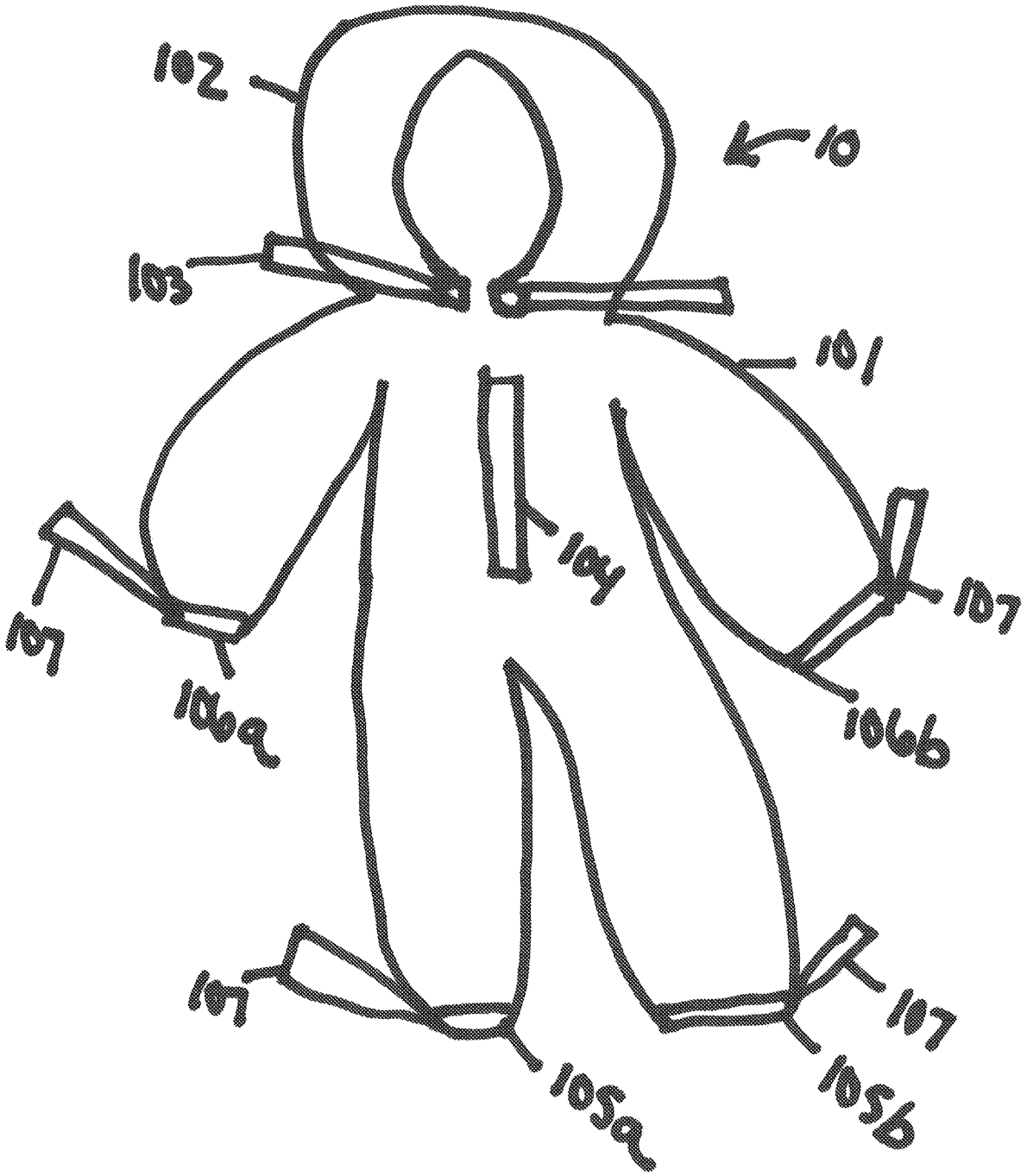
102
10
103
101
104
107
107
106a
106b
107
107
105a
105b

SCREEN JUMPSUIT

CROSS-REFERENCE TO RELATED APPLICATION

The present Application is a non-provisional of, and claims priority to, U.S. Patent Application No. 63/403,064, filed Sep. 1, 2022, the disclosure of which is incorporated by reference in its entirety.

FIELD OF THE DISCLOSURE

The present disclosure generally relates to a jump suit, and more particularly to a jump suit that provides protection from insect bites.

BACKGROUND

It is sometimes challenging to go outside or spend time in the outdoors, such as performing household activities or going to the beach or the park, without being subject to insect bites. While insect sprays can help in preventing insect bites, one must remember to apply (or re-apply) insect spray. Wearing long sleeves or full-length pants can help in minimizing the possibility of insect bites; however, this can be uncomfortable and hot in the summer months.

SUMMARY

Embodiments of the present disclosure may provide a jump screen that may be a jump suit formed of one or more fabrics (and combinations of the same) that may limit access of insects to contact with a wearer's skin. The fabrics may be those that may be used for the mesh of window screens. The jump suit may include drawstrings or other closure mechanisms around the ankle portions and/or wrist portions of the jump suit so that insects may not enter through the ankle or wrist openings of the jump suit to contact with the wearer's skin. The jump suit may include a hood portion having a drawstring that may seal or close around the wearer's face area. The jump suit may include hook and loop fasteners for the wearer to put on the jump suit and close it.

Embodiments of the present disclosure may provide a jump screen comprising a jump suit formed of one or more fabrics that may limit access of insects to penetrate the jump suit to contact with a wearer's skin, the jump suit having ankle portions, wrist portions, a front portion, and a hood portion; drawstrings around the ankle portions and the wrist portions of the jump suit that may close around a wearer's ankles and wrists to limit access of insects to penetrate the jump suit; one or more drawstrings around the hood portion of the jump suit that may close around a face area of the wearer; and a fastening mechanism on the front portion of the jump suit to close the jump suit. The one or more fabrics may be used to form mesh of window screens. The one or more fabrics may be aluminum and fiberglass. The one or more fabrics may be provided in one or more colors selected from the following: natural aluminum, dark aluminum, light gray, applied black, and/or charcoal. The one or more fabrics may be selected from the following: aluminum, fiberglass, nylon, polyester, bronze, copper, brass, stainless steel, galvanized steel, and synthetic screen fabrics. The jump screen may include elastic around the ankle portions and the wrist portions to close openings around the wearer's ankles and wrists. The fastening mechanism may be a hook and loop fastener. The jump screen may be loose fitting to wear over a wearer's regular clothes. The jump screen may be formed of a material that may permit a wearer to wear the jump screen without regular clothes underneath the jump screen.

BRIEF DESCRIPTION OF THE DRAWINGS

For a more complete understanding of this disclosure, reference is now made to the following description, taken in conjunction with the accompanying drawings, in which:

The FIGURE depicts a jump screen according to an embodiment of the present disclosure.

DETAILED DESCRIPTION

Embodiments of the present disclosure may provide a jump screen that may be a jump suit formed of one or more fabrics (and combinations of the same) that may limit access of insects to contact with a wearer's skin. The fabrics may be those that may be used for the mesh of window screens in an embodiment of the present disclosure. Those fabrics may include, but are not limited to, aluminum and fiberglass. These fabrics may be provided in one or more colors in embodiments of the present disclosure but are typically in natural aluminum, dark aluminum, light gray, applied black or charcoal color. Nylon and polyester also may be used in embodiments of the present disclosure, as they may have greater strength than fabrics like aluminum and fiberglass. Other or further screen fabrics may include, but are not limited to, bronze, copper, brass, stainless steel, and galvanized steel, as well as other synthetic screen fabrics. Finer meshes also may be used to prevent very small insects from flying through and/or to prevent pollens and allergens from contacting with the wearer's skin.

The jump suit may include drawstrings around the ankle portions and/or wrist portions of the jump suit so that insects may not enter through the ankle or wrist openings of the jump suit to contact with the wearer's skin. Additionally, or alternatively, elastic or other similar closure mechanisms may be used to limit entry of insects into the jump suit. The jump suit also may include a hood portion having a drawstring that may seal or close around the wearer's face area. The jump suit may include hook and loop fasteners for the wearer to put on the jump suit and close it, such as in the front portion of the jump suit. Additionally, or alternatively, a zipper or other fastening mechanism may be employed to close the jump suit.

The FIGURE depicts jump screen 10 according to an embodiment of the present disclosure. Jump screen 10 may include jump suit 101 having hood portion 102 with drawstring 103 that seals or closes around a face area of the wearer. Hook and loop fasteners 104 may be present on the front portion of jump suit 101 to close jump suit 101 when wearer has donned jump suit 101. While fasteners 104 are depicted having a certain length in the FIGURE, it should be appreciated that the opening which fasteners 104 close may extend from the waist line of jump suit 101 to drawstring(s) 103 so that a wearer may step into jump suit 101 and pull over hood portion 102 before closing fasteners 104 in an embodiment of the present disclosure. Ankle portions 105*a*, 105*b* and/or wrist portions 106*a*, 106*b* may each include drawstrings 107 that may be closed around the wearer's ankles and/or wrists to prevent insects from entering jump suit 101.

It should be appreciated that the jump screen according to embodiments of the present disclosure may be loose fitting such that the jump screen may be worn over the wearer's regular clothes. However, there may be embodiments of the present disclosure where the jump screen may be formed of a material in combination with the screen fabric(s) so that the wearer may not be required to wear regular clothes underneath the jump screen.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A screen jumpsuit comprising:

a jump suit formed of aluminum mesh and fiberglass mesh in the form used to form window screens that limit access of insects to penetrate the jump suit and contact with a wearer's skin, the jump suit having ankle portions, wrist portions, a front portion, and a hood portion;

drawstrings around the ankle portions and the wrist portions of the jump suit that close around the wearer's ankles and wrists respectively to limit access of insects to penetrate the jump suit;

one or more drawstrings around the hood portion of the jump suit that close around a face area of the wearer; and a fastening mechanism on the front portion of the jump suit to close the jump suit.

2. The screen jumpsuit of claim 1, wherein the aluminum and fiberglass are provided in one or more colors selected from the following: natural aluminum, dark aluminum, light gray, applied black, and/or charcoal.

3. The screen jumpsuit of claim 1, jumpsuit is also formed of one or more additional fabrics selected from the following:

nylon, polyester, bronze, copper, brass, stainless steel, galvanized steel, and synthetic screen fabrics.

4. The screen jumpsuit of claim 1 further comprising:

elastic around the ankle portions and the wrist portions to close openings around the wearer's ankles and wrists.

5. The screen jumpsuit of claim 1, wherein the fastening mechanism is a hook and loop fastener.

6. The screen jumpsuit of claim 1, wherein the screen jumpsuit is sized to wear over a wearer's regular clothes.

7. The screen jumpsuit of claim 1, wherein the screen jumpsuit is formed of a non-see-through material that permits a wearer to wear the screen jumpsuit without regular clothes underneath the jump screen.

* * * * *